US012428937B2

(12) United States Patent
Meiners et al.

(10) Patent No.: US 12,428,937 B2
(45) Date of Patent: Sep. 30, 2025

(54) SYSTEM TO SEAL AN EXPANDABLE TUBULAR ACROSS SECTIONS HAVING DIFFERENT DIAMETERS

(71) Applicant: Enventure Global Technology Inc., Houston, TX (US)

(72) Inventors: Matthew John Meiners, Spring, TX (US); Nanda Kishore Boddeda, Houston, TX (US); Roy Nicolas Baker, Westhill Central (GB)

(73) Assignee: Enventure Global Technology Inc., Houston, TX (US)

( * ) Notice: Subject to any disclaimer, the term of this patent is extended or adjusted under 35 U.S.C. 154(b) by 0 days.

(21) Appl. No.: 18/567,706

(22) PCT Filed: Jun. 10, 2022

(86) PCT No.: PCT/US2022/033073
§ 371 (c)(1),
(2) Date: Dec. 6, 2023

(87) PCT Pub. No.: WO2022/261476
PCT Pub. Date: Dec. 15, 2022

(65) Prior Publication Data

US 2024/0263545 A1 Aug. 8, 2024

Related U.S. Application Data

(60) Provisional application No. 63/209,596, filed on Jun. 11, 2021.

(51) Int. Cl.
*E21B 43/10* (2006.01)

(52) U.S. Cl.
CPC ..... *E21B 43/105* (2013.01)

(58) Field of Classification Search
CPC ..... E21B 43/105
See application file for complete search history.

(56) References Cited

U.S. PATENT DOCUMENTS 7,172,024 B2 * 2/2007 Cook ..... E21B 17/08 166/207
9,494,020 B2 * 11/2016 Galloway ..... E21B 43/108
(Continued)

FOREIGN PATENT DOCUMENTS

CN 108240205 B * 9/2023 ..... E21B 43/105
WO 2017004336 A1 1/2017
WO 2017004337 A1 1/2017

OTHER PUBLICATIONS

USPTO, International Search Report in parent application serial No. PCT/US22/33073, mailed on Sep. 21, 2022, 11 pages.

*Primary Examiner* — Jennifer H Gay
(74) *Attorney, Agent, or Firm* — Jonathan Pierce; Derek V. Forinash; Porter Hedges LLP

(57) ABSTRACT

Tubulars are used to seal a leak in completion equipment, such as parted connection (or parted casing) or damaged casing, isolate a casing perforation or an open hole zone, by expanding the tubulars over the leak, perforation, or zone, where the inner diameters of sections of the completion equipment above and below the leak, perforation, or zone are different. Alternatively, the tubulars are used to apply a liner over an open hole section and anchor the liner onto a base casing. The tubulars preferably function as cladding. An apparatus for expanding the tubulars includes a lower fixed-diameter cone, an upper fixed-diameter cone, and a drill pipe passing through the upper fixed-diameter cone and attached to the lower fixed-diameter cone. The drill pipe can slide through the upper fixed-diameter cone or be attached to the upper fixed-diameter cone.

21 Claims, 2 Drawing Sheets

(56) References Cited

U.S. PATENT DOCUMENTS

| | | | | |
|---|---|---|---|---|
| 10,450,846 | B2 * | 10/2019 | Jabs | E21B 43/108 |
| 2003/0116325 | A1 * | 6/2003 | Cook | E21B 17/1042<br>166/381 |
| 2004/0069499 | A1 * | 4/2004 | Cook | E21B 43/105<br>166/207 |
| 2015/0292305 | A1 * | 10/2015 | Galloway | E21B 43/105<br>166/380 |
| 2018/0119527 | A1 * | 5/2018 | Jabs | E21B 43/105 |
| 2024/0263545 | A1 * | 8/2024 | Meiners | E21B 43/103 |

* cited by examiner

SYSTEM TO SEAL AN EXPANDABLE TUBULAR ACROSS SECTIONS HAVING DIFFERENT DIAMETERS

CROSS-REFERENCE TO RELATED APPLICATIONS

This application claims the benefit of priority to U.S. provisional application Ser. No. 63/209,596 filed on Jun. 11, 2021, which is incorporated herein by reference for all and any purposes.

BACKGROUND

This disclosure relates generally to methods and apparatus for sealing an expandable tubular, patch, or liner against two sections in a wellbore, where the two sections have different inner diameters. The sections may be completed or open hole. This disclosure relates more particularly to methods and apparatus where the expandable tubular, patch, or liner can be placed in the wellbore and expanded against the two sections in a single trip.

Wellbores are drilled and constructed with completion equipment, such as casings, liners, and/or production tubings, that contains fluid circulation inside the completion equipment. As such, the completion equipment prevents contamination of the formations surrounding the wellbore with the circulating fluid, and/or prevents contamination of the circulating fluid with other fluids contained in the pores of the formations surrounding the wellbore. Sometimes, such a piece of completion equipment may fail, for example, the wall of the completion equipment may crack, or a connection between two sections of the completion equipment may part. When the crack or parted connection is located in a section of tubulars having a sufficiently constant diameter, it is known to remediate these types of failure by expanding a patch inside the completion equipment.

When the crack or parted connection is located close to the transition between two tubular sections in a wellbore, where the two tubular sections have different inner diameters, it may still be possible to expand a patch in one of the two tubular sections and seal the crack or parted connection. However, it becomes difficult to properly place the patch over the crack or parted connection and expand it so that the crack or parted connection is sealed. Instead, it may be advantageous in some cases to seal an expandable patch against the two tubular sections in the wellbore.

Sealing an expandable patch against the two tubular sections having different inner diameters may be performed by simple duplication of the process of sealing an expandable patch over a single tubular section having a constant diameter. This simple duplication would entail conveying the expandable patch on a first expansion assembly configured to expand the patch against one of the two tubular sections, using the first expansion assembly to partially expand the patch, retrieving the first expansion assembly, conveying a second expansion assembly configured to expand the patch against the other of the two tubular sections, and using the second expansion assembly to complete the expansion of the patch. However, such a process requires the consecutive trippings of two different expansion assemblies, and thus may take an excessive duration and/or have an excessive cost. An additional third trip may be needed to mill a shoe provided at the end of the patch, further increasing the duration and/or cost of the operation.

There is a continuing need in the art for methods and apparatus for sealing an expandable patch against two tubular sections in a wellbore, where the two tubular sections have different inner diameters, wherein the expandable patch can be placed in the wellbore and expanded against the two tubular sections in fewer trips.

BRIEF SUMMARY OF THE DISCLOSURE

The disclosure describes a method and apparatus that can be used to seal a leak in completion equipment, such as parted connection (or parted casing) or damaged casing, isolate a casing perforation or an open hole zone, by expanding tubulars over the leak, perforation, or zone, where the inner diameters of the tubular sections of the completion equipment above and below the leak, perforation, or zone are different. The expandable tubulars function as cladding. If expanded in sections of completion equipment, the tubulars may be referred to as patches. If expanded in open hole sections, the tubulars may be referred to as liners. For example, the method and apparatus described in this disclosure may be especially beneficial if the leak is close to the transition between the different diameters because a conventional patch usually cannot be deployed effectively. Likewise, the method and apparatus described in this disclosure may be especially beneficial, to apply a liner over an open hole section and anchor the liner onto a base casing.

The apparatus comprises a first assembly that includes a lower tubular and a lower fixed-diameter cone. The lower fixed-diameter cone is located in a lower launcher connected at the lower end of the lower tubular. The lower fixed-diameter cone and the lower tubular are dimensioned to expand the lower tubular so that it seals against the lower section, which has a first inner diameter. In some cases, the lower launcher may include a shoe at its bottom end. The shoe includes a port that can be obturated (e.g., using a dart or ball). The shoe is preferably drillable.

The apparatus comprises a second assembly that includes an upper tubular and an upper fixed-diameter cone. The upper fixed-diameter cone is located in an upper launcher connected at the lower end of the upper tubular. The upper fixed-diameter cone and the upper tubular are dimensioned to expand the upper tubular so that it seals against the upper section, which has a second inner diameter that is larger than the first inner diameter. The upper launcher is adapted so that the top of the lower tubular can be connected (e.g., threaded) to and seal against the bottom of the upper launcher. As such, the second assembly is structurally attached to the first assembly. Preferably, the upper launcher may include a mechanism to hold the upper fixed-diameter cone in place.

The apparatus comprises a drill pipe that is attached to the lower fixed-diameter cone and passes through the upper fixed-diameter cone. In some embodiments, the drill pipe can slide through the upper fixed-diameter cone. In other embodiments, the drill pipe is attached to the upper fixed-diameter cone.

Optionally, the apparatus may comprise an operational casing. If so, the top of the upper tubular is adapted to be connected (e.g., threaded) to the operational casing. The connection between the top of the upper tubular and the operational casing is adapted to release when the top of the upper tubular is expanded. However, the lower and upper tubulars are preferably run-in-hole to a setting depth, held using drill pipe and weight, and do not separate.

Both the first and second assemblies, as well as the operational casing if provided, are assembled around the drill pipe in tandem as one apparatus. Then, the apparatus is positioned at a setting depth in the wellbore so that the lower tubular is located in the lower section, which has the first (i.e., smaller) inner diameter, and the upper tubular is located in the upper section, which has the second (i.e., larger) inner diameter.

The lower and the upper tubulars are expanded with the lower and the upper fixed-diameter cones, respectively. In some embodiments, the expansion is driven by hydraulic pressure generated by pumping fluid into the drill pipe. The pumped fluid exits through a port in the drill pipe into a variable volume chamber. In some embodiments, the expansion is driven by mechanical traction generated by pulling the drill pipe. The lower and the upper tubulars can expand consecutively or simultaneously.

After the lower and the upper tubulars are expanded, the drill pipe, the lower and upper fixed-diameter cones, and the operational casing, if provided, are retrieved from the wellbore, leaving the lower and upper tubulars at the setting depth and sealed against the first and second sections, respectively.

In some cases, a milling tool is then used to drill out the shoe.

BRIEF DESCRIPTION OF THE DRAWING

For a more detailed description of an embodiment, reference will now be made to the accompanying FIGURE, which is a schematic illustrating an example of an apparatus capable of expanding lower and upper tubulars to different diameters in a single trip.

DETAILED DESCRIPTION

Figure 1:
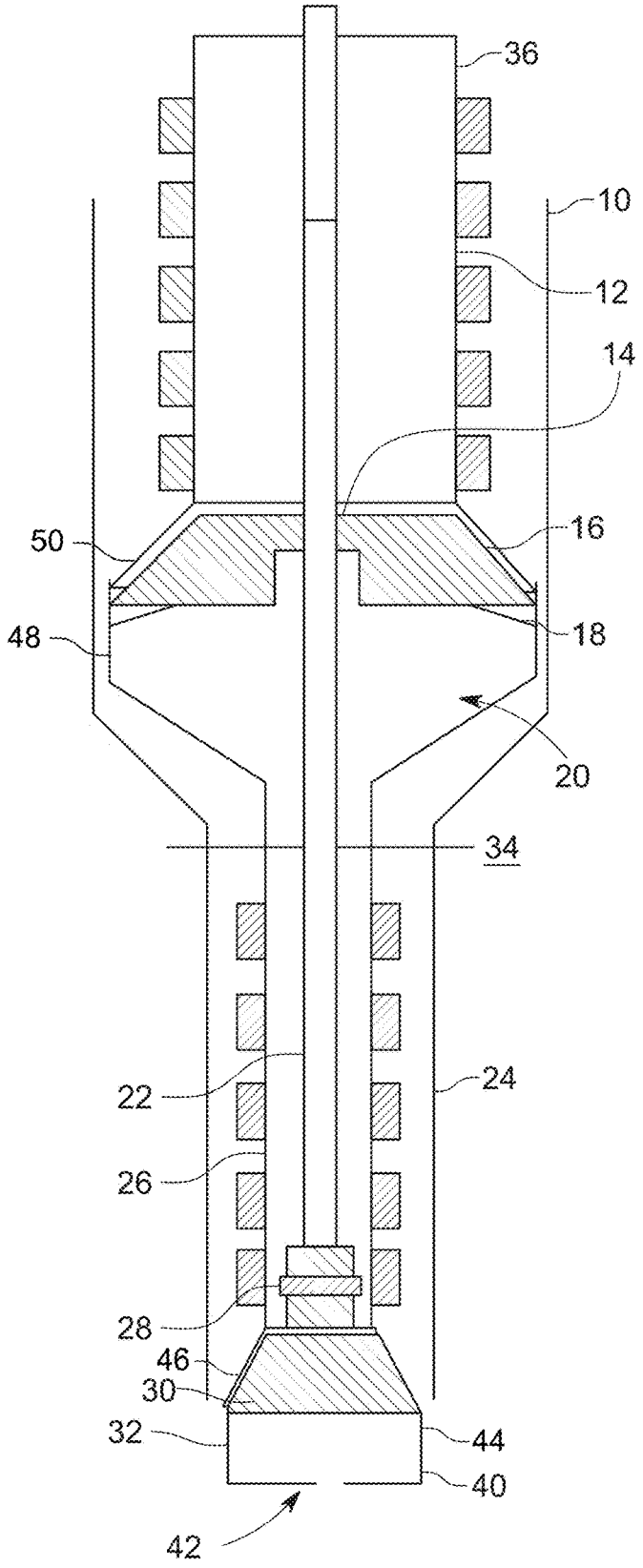
Figure 2:
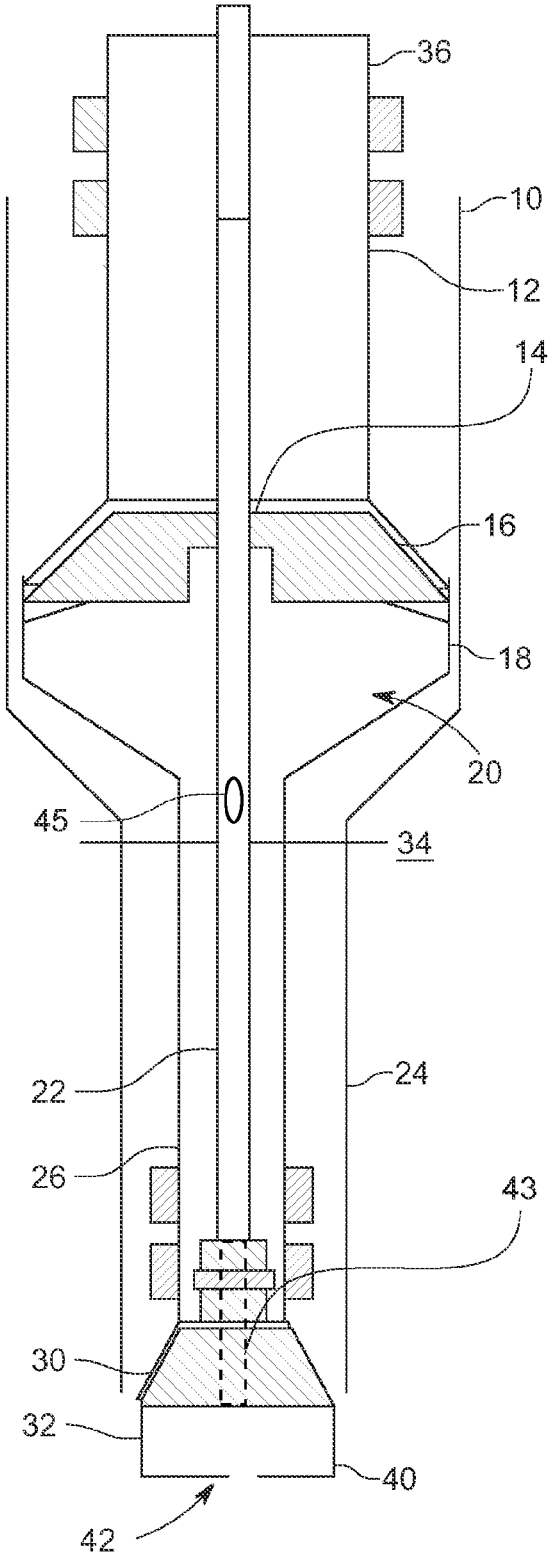

FIGS. 1 and 2 are schematic views, each illustrating an example of an apparatus that can be used to seal a leak 34 in completion equipment by expanding patches above and below leak 34, where the inner diameters of the tubular sections of the completion equipment above and below the leak are different. While FIGS. 1 and 2 are described in the context of sealing the leak 34 in completion equipment, the example apparatus can alternatively be used to seal a casing perforation, or isolate an open hole zone where fluid losses or gains occur.

As is customary, FIGS. 1 and 2 not to scale for the sake of simplicity and clarity. The apparatus is illustrated in a wellbore in which completion equipment has been installed. As an example, the completion equipment includes an upper section completed with a wellhead casing 10, such as having a typical inner diameter of 18¾ inches, and a lower section completed with a casing 24, such as having a typical inner diameter of 13⅜ inches. In the example shown, the leak 34 caused by a connection parting is shown close to the transition between the diameters of the upper and lower sections of the completion equipment.

The lower launcher 32 is connected to the bottom of the lower patch 26. The lower patch 26 may be single-joint, or multiple-joint, and includes several outer seals made of elastomer. The lower fixed-diameter cone 30 is disposed in the lower launcher 32. The lower launcher 32 includes a metallic cylinder 44 and a lower shoulder 46 connected between the metallic cylinder 44 and the lower patch 26 (i.e., a lower tubular). The lower shoulder 46 is metallic and plastically deformable, and configured to rest on the lower fixed-diameter cone 30. For example, the lower patch 26 may have an initial inner diameter of 11¾ inches, which is expandable to a drift diameter of 12.440 inches by the lower fixed-diameter cone 30.

The upper launcher 20 is connected to the bottom of the upper patch 12. The upper patch 12 may be single-joint, or multiple-joint, and includes several outer seals made of elastomer. The upper fixed-diameter cone 16 is disposed in the upper launcher 20. The upper launcher 20 includes a metallic cylinder 48 and an upper shoulder 50 connected between the metallic cylinder 48 and the upper patch 12 (i.e., an upper tubular). The upper shoulder 50 is metallic and plastically deformable, and configured to rest on the upper fixed-diameter cone 16. For example, the upper patch 12 may have an initial inner diameter of 16 inches, which is expandable to a drift diameter of 17.300 inched by the upper fixed-diameter cone 16.

The upper patch 12 is connected to, and spaced properly from, the lower patch 26. This connection is achieved by properly sizing the upper launcher 20 and adapting the upper launcher 20 to be threaded to the top of the lower patch 26, directly or indirectly. Optionally, a mechanism 18 configured to hold the upper fixed-diameter cone 16 in place is provided in the upper launcher 20. The lower launcher 32 may be standard, and in the example shown, includes a shoe 40 that is drillable.

The drill pipe 22 is attached to the lower fixed-diameter cone 30. In the example shown, the drill pipe 22 passes through an opening 14 in the upper fixed-diameter cone 16.

The apparatus could be designed and built to operate in various ways.

1) Consecutive Expansions in FIG. 1.

Firstly, the lower patch 26 is expanded by obturating the port 42 in the shoe 40 included at the lower end of the lower launcher 32 and by pumping fluid into the drill pipe 22. The pumped fluid exits the drill pipe 22 below the lower fixed-diameter cone 30 into a variable volume chamber formed between the shoe 40 and a seal located around the lower fixed-diameter cone 30. As the pressure increases in the chamber, a force pushing the lower fixed-diameter cone 30 up is generated, as well as a force pushing the lower launcher 32 down. The force pushing the lower launcher 32 down can be resisted by the drill pipe 22, cladded elastomers, or using the operational casing 36. The force pushing the lower fixed-diameter cone 30 up causes the lower fixed-diameter cone 30 to move up and expand the lower patch 26. When the lower fixed-diameter cone 30 moves up, the drill pipe 22 slides through the opening 14 in the upper fixed-diameter cone 16. Fluid located above the lower fixed-diameter cone 30 also passes through the opening 14. At the end of the expansion of the lower patch 26, a stick-out 28 lands into the opening 14, latches the lower fixed-diameter cone 30 to the upper fixed-diameter cone 16, and prevents fluid from continuing to pass through the opening 14.

Secondly, the pumped fluid continues exiting the drill pipe 22 into a variable volume chamber, but the variable chamber is now formed between the shoe 40, a seal located around the upper fixed-diameter cone 16, and a seal located around the stick-out 28. Expansion pressure is now exerted on the upper fixed-diameter cone 16 to expand the upper patch 12.

Then, at the end of the expansion of the upper patch 12, the drill pipe 22, the lower fixed-diameter cone 30, the upper fixed-diameter cone 16, and the operational casing 36 are retrieved from the wellbore. The shoe 40 at the bottom of the lower launcher 32 is finally drilled out.

2) Simultaneous Expansion in FIG. 2.

Unlike the example shown in FIG. 1, the drill pipe 22 is attached to both the lower fixed-diameter cone 30 and the upper fixed-diameter cone 16, and no fluid can pass through the opening 14. To expand the lower patch 26 and the upper patch 12, the volume between the top of the lower fixed-diameter cone 30 and the bottom of the upper fixed-diameter cone 16 is pressurized and back-filled. Furthermore, the volume between the shoe and under the lower fixed-diameter cone 30 is also back-filled; however, it may or may not be pressurized. For example, no seal is provided around the lower fixed-diameter cone 30, so that pumped fluid may leak around the lower fixed-diameter cone 30. Alternatively, the pumped fluid can exit the drill pipe 22 between the lower fixed-diameter cone 30 and the upper fixed-diameter cone 16 at 45 and as well as below the lower fixed-diameter cone 30 via 43, so that fluid may exit into a variable volume chamber formed between the shoe 40 and a seal located around the upper fixed-diameter cone 16.

The lower patch 26 and the upper patch 12 are expanded by obturating the port in the drill pipe 22 and/or the shoe 40 included at the lower end of the lower launcher 32 and by pumping fluid into the drill pipe 22. Expansion pressure is applied to the bottom of the upper fixed-diameter cone 16 (as well as on the top and bottom of the lower fixed-diameter 30, which has no net effect). The expansion pressure is driven sufficiently high to generate the force required to expand the upper patch 12, plus the force required to expand the lower patch 26. In the example shown, approximately 2700 psi may be necessary to expand the upper patch 12 and clad the outer seals of the upper patch 12 on the wellhead casing 10. An additional 750-1000 psi would be required to create the excess force necessary to simultaneously expand the lower patch 26.

There may be a risk of trapping fluid between the outer seals of the upper patch 12 and the outer seals of the lower patch 26 if both the upper patch 12 and the lower patch 26 are expanded simultaneously, potentially leading to hydraulic lock. Indeed, the annular volume between the outer diameters of the expanding lower patch 26 and upper patch 12, and the inner diameters of the casings 10 and/or 24 is reduced as the upper patch 12 and the lower patch 26 are expanded. The fluid contained in this annular volume preferably flows somewhere else, preferably up-hole. However, if one of the outer seals of the upper patch 12 and one of the outer seals of the lower patch 26 are clad, the fluid is trapped between the outer seals and its pressure increases. In turn, the pressure increase may hydraulically lock further displacement of the lower fixed-diameter cone 30 and the upper fixed-diameter cone 16, or may bust an outer seal. In order to alleviate the risk of hydraulic lock or seal busting, all the outer seals of the lower patch 26 are clad before any of the outer seals of the upper patch 12. For example, the outer seals of the upper patch 12 may be spaced sufficiently apart from the outer seals of the lower patch 26 such that the lower fixed-diameter cone 30 is no longer expanding the lower patch 26, and all the outer seals of the lower patch 26 are expanded when the first outer seal of the upper patch 12 is expanded.

Then, the drill pipe 22, the lower fixed-diameter cone 30, the upper fixed-diameter cone 16, and the operational casing 36 are retrieved from the wellbore. The shoe at the bottom of the lower launcher 32 is then drilled out.

3) Casing Jacks.

For shallow deployments, casing jacks (not shown) or other devices can be used to exert an overpull on the drill pipe 22 to simultaneously expand the lower patch 26 and the upper patch 12.

In some cases, the drill pipe 22 is attached to both the lower fixed-diameter cone 30 and the upper fixed-diameter cone 16. The upward force of the lower patch 26 and the upper patch 12 that is caused by friction between the lower fixed-diameter cone 30 and the lower patch 26 and/or between the upper fixed-diameter cone 16 and the upper patch 12, is resisted by the operational casing 36. While the force resisting the upward movement of the lower patch 26 and the upper patch 12 is larger when using casing jacks than when using pressurized fluid to expand the lower patch 26 and the upper patch 12, the use of casing jacks would not require a shoe and therefore would eliminate the need for a drill out.

Alternatively, the casing jacks (not shown) or other devices can be used to exert an overpull on the drill pipe 22 to successively or consecutively expand the lower patch 26 and the upper patch 12. In these cases, the drill pipe 22 can be attached to the lower fixed-diameter cone 30 and initially slide through the upper fixed-diameter cone 16 until the stick-out 28 lands into the opening 14, and latches the lower fixed-diameter cone 30 to the upper fixed-diameter cone 16.

In addition to the foregoing, the disclosure contemplates at least the following embodiments.

Embodiment 1

Embodiment 1 is an apparatus for use in a wellbore. The apparatus includes a first assembly, a second assembly, and a drill pipe.

The first assembly generally includes a first tubular, a first launcher, and a first fixed-diameter cone. The first launcher is preferably connected at the lower end of the first tubular. The first fixed-diameter cone is preferably located in the first launcher. The drill pipe is preferably attached to the first fixed-diameter cone.

Similarly, the second assembly includes a second tubular, a second launcher, and a second fixed-diameter cone. The second launcher is preferably connected at a lower end of the second tubular. The second fixed-diameter cone is preferably located in the second launcher. The drill pipe preferably passes through the second fixed-diameter cone and may or may not be attached to the second fixed-diameter cone. Optionally, the second assembly includes a mechanism located in the second launcher and configured to support the second fixed-diameter cone.

The first tubular is connected to, and preferably also seals against, the second launcher. For example, the top of the first tubular is connected to, and preferably also seals against, the bottom of the second launcher.

The diameter of the first fixed-diameter cone is smaller than the diameter of the second fixed-diameter cone.

Embodiment 2

Embodiment 2 is an apparatus as described in embodiment 1, wherein the first fixed-diameter cone is configured to radially expand the first tubular, and the second fixed-diameter cone is configured to radially expand the second tubular.

In particular, the first fixed-diameter cone may be sized, sufficiently rigid, and may have a suitable finish to travel through the first tubular and plastically deform the first tubular to a larger diameter. Similarly, the second fixed-diameter cone may be sized, sufficiently rigid, and may have a suitable finish to travel through the second tubular and plastically deform the second tubular to a larger diameter.

Embodiment 3

Embodiment 3 is an apparatus as described in embodiments 1 or 2, wherein the first tubular includes a first metallic and plastically deformable cylinder and a first plurality of elastomeric seals. Each of the first plurality of elastomeric seals is disposed outside the first metallic cylinder and around the first metallic cylinder. Similarly, the second tubular includes a second metallic and plastically deformable cylinder and a second plurality of elastomeric seals. Each of the second plurality of elastomeric seals is disposed outside the second metallic cylinder and around the second metallic cylinder. The diameter of the first tubular is smaller than the diameter of the second tubular.

The first tubular may be unitary or may be made of a plurality of joints connected to one another. Similarly, the second tubular may be unitary or may be made of a plurality of joints connected to one another.

Embodiment 4

Embodiment 4 is an apparatus as described in any of embodiments 1 to 3, wherein the first launcher includes a first metallic cylinder and a first shoulder connected between the first metallic cylinder and the first tubular. Similarly, the second launcher includes a second metallic cylinder and a second shoulder connected between the second metallic cylinder and the second tubular. For example, the first shoulder and/or the second shoulder may have a conical shape.

The first shoulder is preferably metallic and plastically deformable. The first shoulder is preferably configured (e.g., is sized, inclined, and/or has sufficient strength) to rest on the first fixed-diameter cone.

The second shoulder is preferably metallic and plastically deformable. The second shoulder is preferably configured (e.g., is sized, inclined, and/or has sufficient strength) to rest on the second fixed-diameter cone.

Embodiment 5

Embodiment 5 is an apparatus as described in any of embodiments 1 to 4, wherein the first launcher includes a shoe. The shoe has a port that is capable of (e.g., is sufficiently small and/or is suitably located for) being closed with an obturator, such as a ball or dart, dropped inside a bore of the drill pipe and carried by fluid pumped into the bore of the drill pipe. The shoe is preferably made of a material drillable with a known type drill bit or reamer.

Embodiment 6

Embodiment 6 is an apparatus as described in any of embodiments 1 to 5, wherein the drill pipe is configured to deliver fluid pumped into the bore of the drill pipe below the first fixed-diameter cone, and the first fixed-diameter cone includes a seal capable of sealing against the first launcher and the first tubular while the first tubular is expanded. As such, the fluid pumped into the bore of the drill pipe may be trapped below the first fixed-diameter cone. When the pressure in the trapped fluid increases, the fluid can push the first fixed-diameter cone upward, causing the expansion of the first tubular.

In this embodiment, the drill pipe preferably passes through an opening in the second fixed-diameter cone. The opening is configured (e.g., is sufficiently large and exhibits low surface friction) such that the drill pipe can slide through the opening while the first tubular is expanded. The opening is also configured such that fluid located above the first fixed-diameter cone can pass through the opening while the first tubular is expanded.

Preferably, but not necessarily, the first assembly includes a stick-out located above the first fixed-diameter cone. If provided, the stick-out is sized to land into the opening in the second fixed-diameter cone. The stick-out is also configured (e.g., includes a properly sized O-ring) to seal the first fixed-diameter cone against the second fixed-diameter cone so as to prevent the fluid located above the first fixed-diameter cone from continuing to pass through the opening after the stick-out has landed into the opening in the second fixed-diameter cone. Optionally, the stick-out is configured to latch (e.g., lock in place) the first fixed-diameter cone to the second fixed-diameter cone after the stick-out has landed into the opening in the second fixed-diameter cone.

Embodiment 7

Embodiment 6 is an apparatus as described in any of embodiments 1 to 5, wherein the drill pipe is attached to both the first fixed-diameter cone and the second fixed-diameter cone. The drill pipe is configured to deliver fluid pumped into the bore of the drill pipe below the second fixed-diameter cone. The second launcher, the second tubular, the second fixed-diameter cone, and the drill pipe are configured so that no or little fluid can pass across the second fixed-diameter cone. For example, if the drill pipe passes through an opening in the second fixed-diameter cone, the opening is configured so that no fluid can pass through the opening. Also, the second fixed-diameter cone can include a seal capable of sealing against the second launcher and the second tubular while the first tubular and the second tubular are expanded.

Embodiment 8

Embodiment 8 is an apparatus as described in embodiment 7, wherein an obturator, such as a ball or dart, is landed on an inner shoulder in the drill pipe to close the bore of the drill pipe, and a passageway is provided across the drill pipe above the inner shoulder and below the second fixed-diameter cone. The passageway may or may not include a burst disk.

Optionally, wellbore fluid can enter the first launcher and/or the first tubular via a port provided in a shoe.

Embodiment 9

Embodiment 9 is an apparatus as described in embodiment 7, wherein an obturator, such as a ball or dart, is landed to close a port in a shoe. The drill pipe is configured to also deliver fluid pumped into the bore of the drill pipe below the first fixed-diameter cone.

Embodiment 10

Embodiment 10 is an apparatus as described in any of embodiments 1 to 5, further comprising casing jacks or equivalent devices configured to exert an overpull on the drill pipe.

Embodiment 11

Embodiment 11 is an apparatus as described in embodiment 10, wherein the drill pipe is attached to both the first fixed-diameter cone and the second fixed-diameter cone to simultaneously expand the first tubular and the second tubular.

Embodiment 12

Embodiment 12 is an apparatus as described in embodiment 10, wherein the drill pipe is attached to the first fixed-diameter cone and initially slides through the second fixed-diameter cone until a stick-out lands into an opening in the second fixed-diameter cone. Thus, the first tubular and the second tubular are successively or consecutively expanded.

Embodiment 13

Embodiment 13 is an apparatus as described in any of embodiments 10 to 12, combining mechanical expansion with hydraulic expansion using one or more features described in any of embodiments 6 to 9.

Embodiment 14

Embodiment 14 is an apparatus as described in any of embodiments 1 to 13, further comprising an operational casing. A top of the second tubular is connected to the operational casing. A connection between the top of the second tubular and the operational casing is adapted to release after the second tubular is expanded.

Embodiment 15

Embodiment 15 is a method for sealing a patch or liner against a lower section and an upper section in a wellbore, wherein the lower section and the upper section have different inner diameters.

The method comprises the steps of providing an apparatus as described in any of embodiments 1 to 14, running-in-hole the apparatus, radially expanding the first tubular using the first fixed-diameter cone, and radially expanding the second tubular using the second fixed-diameter cone. These steps are performed before retrieving the drill pipe, the first fixed-diameter cone and the second fixed-diameter cone from the wellbore.

Embodiment 16

Embodiment 16 is a method as described in embodiment 15, further comprising the steps of sealing the first tubular against the lower section of the wellbore and sealing the second tubular against the upper section of the wellbore. These steps are performed before retrieving the first fixed-diameter cone and the second fixed-diameter cone from the wellbore.

The invention is susceptible to various modifications and alternative forms, and specific embodiments thereof are shown by way of example in the drawings and description. It should be understood, however, that the drawings and detailed description thereto are not intended to limit the invention to the particular form disclosed, but on the contrary, the intention is to cover all modifications, equivalents, and alternatives falling within the scope of the disclosure.

What is claimed is:

1. An apparatus for use in a wellbore, comprising:

a first assembly, wherein the first assembly includes a lower tubular, a lower launcher connected at a lower end of the lower tubular, and a lower fixed-diameter cone located in the lower launcher;

a second assembly, wherein the second assembly includes an upper tubular, an upper launcher connected at a lower end of the upper tubular, and an upper fixed-diameter cone located in the upper launcher; and a drill pipe passing through an opening in the upper fixed-diameter cone and attached to both the lower fixed-diameter cone and the upper fixed-diameter cone for simultaneous expansion of the lower tubular and the upper tubular;

wherein the drill pipe is configured to deliver fluid pumped into a bore of the drill pipe below the lower fixed-diameter cone and between the lower fixed-diameter cone and the upper fixed-diameter cone;

wherein a top of the lower tubular is connected to and seals against a bottom of the upper launcher;

wherein a diameter of the lower fixed-diameter cone is smaller than a diameter of the upper fixed-diameter cone.

2. The apparatus of claim 1, wherein:

the lower fixed-diameter cone is configured to radially expand the lower tubular; and the upper fixed-diameter cone is configured to radially expand the upper tubular.

3. The apparatus of claim 2, wherein:

the lower tubular includes a metallic and plastically deformable cylinder and a plurality of elastomeric seals, each disposed outside the metallic cylinder and around the metallic cylinder;

the upper tubular includes a metallic and plastically deformable cylinder and a plurality of elastomeric seals, each disposed outside the metallic cylinder and around the metallic cylinder; and a diameter of the lower tubular is smaller than a diameter of the upper tubular.

4. The apparatus of claim 3, wherein:

the lower launcher includes a metallic cylinder and a lower shoulder connected between the metallic cylinder and the lower tubular;

the lower shoulder is metallic and plastically deformable, and configured to rest on the lower fixed-diameter cone;

the upper launcher includes a metallic cylinder and an upper shoulder connected between the metallic cylinder and the upper tubular; and the upper shoulder is metallic and plastically deformable, and configured to rest on the upper fixed-diameter cone.

5. The apparatus of claim 1, wherein no seal is provided around the lower fixed-diameter cone, so that the fluid exiting the drill pipe below the lower fixed-diameter cone leaks around the lower fixed-diameter cone into a volume between the lower fixed-diameter cone and the upper fixed-diameter cone.

6. The apparatus of claim 1, wherein the fluid pumped into the bore of the drill pipe exits the drill pipe between the lower fixed-diameter cone and the upper fixed-diameter cone, as well as below the lower fixed-diameter cone.

7. An apparatus for use in a wellbore, comprising:

a first assembly, wherein the first assembly includes a lower tubular, a lower launcher connected at a lower end of the lower tubular, and a lower fixed-diameter cone located in the lower launcher;

a second assembly, wherein the second assembly includes an upper tubular, an upper launcher connected at a lower end of the upper tubular, and an upper fixed-diameter cone located in the upper launcher; and a drill pipe passing through the upper fixed-diameter cone and attached to the lower fixed-diameter cone;

wherein:

the drill pipe is configured to deliver fluid pumped into a bore of the drill pipe below the lower fixed-diameter cone;

the lower fixed-diameter cone includes a seal located around the lower fixed-diameter cone capable of sealing against the lower launcher and the lower tubular while the lower tubular is expanded; and the drill pipe passes through an opening in the upper fixed-diameter cone, the opening being configured such that the drill pipe slides through the opening and fluid located above the lower fixed-diameter cone passes through the opening while the lower tubular is expanded;

the first assembly includes a stick-out located above the lower fixed-diameter cone;

the stick-out is sized to land into the opening in the upper fixed-diameter cone;

the stick-out is configured to seal the lower fixed-diameter cone against the upper fixed-diameter cone so as to prevent the fluid located above the lower fixed-diameter cone from continuing to pass through the opening after the stick-out has landed into the opening in the upper fixed-diameter cone;

a top of the lower tubular is connected to and seals against a bottom of the upper launcher; and a diameter of the lower fixed-diameter cone is smaller than a diameter of the upper fixed-diameter cone.

8. The apparatus of claim 7, wherein the lower launcher includes a shoe, the shoe being made of drillable material and having a port that is capable of being closed with an obturator dropped inside the bore of the drill pipe.

9. The apparatus of claim 8, wherein a variable volume chamber is formed between the shoe and the seal located around the lower fixed-diameter cone after closing the port with the obturator so that the fluid delivered below the lower fixed-diameter cone increases pressure in the variable volume chamber.

10. The apparatus of claim 7, wherein:

the stick-out is configured to latch the lower fixed-diameter cone to the upper fixed-diameter cone after the stick-out has landed into the opening in the upper fixed-diameter cone; and the second assembly includes a mechanism located in the upper launcher and configured to support the upper fixed-diameter cone.

11. The apparatus of claim 10, further comprising an operational casing, wherein a top of the upper tubular is connected to the operational casing, and wherein a connection between the top of the upper tubular and the operational casing is adapted to release after the upper tubular is expanded.

12. A method for sealing a patch or liner against a lower section and an upper section in a wellbore, wherein the lower section and the upper section have different inner diameters, the method comprising:

providing a first assembly, wherein the first assembly includes a lower tubular, a lower launcher connected at a lower end of the lower tubular, and a lower fixed-diameter cone located in the lower launcher;

providing a second assembly, wherein the second assembly includes an upper tubular, an upper launcher connected at a lower end of the upper tubular, and an upper fixed-diameter cone located in the upper launcher; and wherein a diameter of the lower fixed-diameter cone is smaller than a diameter of the upper fixed-diameter cone;

providing a drill pipe passing through an opening in the upper fixed-diameter cone and attached to both the lower fixed-diameter cone and the upper fixed-diameter cone;

connecting a top of the lower tubular to a bottom of the upper launcher;

sealing the top of the lower tubular against the bottom of the upper launcher;

holding the first assembly and the second assembly using the drill pipe;

running-in-hole the first assembly and the second assembly;

delivering fluid pumped into a bore of the drill pipe below the lower fixed-diameter cone and between the lower fixed-diameter cone and the upper fixed-diameter cone;

radially expanding the lower tubular using the lower fixed-diameter cone and the upper tubular using the upper fixed-diameter cone simultaneously;

sealing the lower tubular against the lower section of the wellbore;

sealing the upper tubular against the upper section of the wellbore; and retrieving the drill pipe, the lower fixed-diameter cone and the upper fixed-diameter cone from the wellbore.

13. The method of claim 12, wherein:

the lower tubular includes a metallic and plastically deformable cylinder and a plurality of elastomeric seals, each disposed outside the metallic cylinder and around the metallic cylinder;

the upper tubular includes a metallic and plastically deformable cylinder and a plurality of elastomeric seals, each disposed outside the metallic cylinder and around the metallic cylinder; and a diameter of the lower tubular is smaller than a diameter of the upper tubular.

14. The method of claim 13, wherein:

the lower launcher includes a metallic cylinder and a lower shoulder connected between the metallic cylinder and the lower tubular;

the lower shoulder is metallic and plastically deformable;

the upper launcher includes a metallic cylinder and an upper shoulder connected between the metallic cylinder and the upper tubular; and the upper shoulder is metallic and plastically deformable;

the method comprising:

resting the lower shoulder on the lower fixed-diameter cone; and resting the upper shoulder on the upper fixed-diameter cone.

15. The method of claim 12, wherein no seal is provided around the lower fixed-diameter cone, so that the fluid delivered below the lower fixed-diameter cone leaks around the lower fixed-diameter cone into a volume between the lower fixed-diameter cone and the upper fixed-diameter cone.

16. The method of claim 12, wherein the fluid pumped into the bore of the drill pipe exits the drill pipe between the lower fixed-diameter cone and the upper fixed-diameter cone, as well as below the lower fixed-diameter cone.

17. A method for sealing a patch or liner against a lower section and an upper section in a wellbore, wherein the lower section and the upper section have different inner diameters, the method comprising:

providing a first assembly, wherein the first assembly includes a lower tubular, a lower launcher connected at a lower end of the lower tubular, and a lower fixed-diameter cone located in the lower launcher, wherein the lower fixed-diameter cone includes a seal capable of sealing against the lower launcher and the lower tubular while the lower tubular is expanded, wherein the first assembly includes a stick-out located above the lower fixed-diameter cone;

providing a second assembly, wherein the second assembly includes an upper tubular, an upper launcher connected at a lower end of the upper tubular, and an upper fixed-diameter cone located in the upper launcher; and wherein a diameter of the lower fixed-diameter cone is smaller than a diameter of the upper fixed-diameter cone;

providing a drill pipe passing through the upper fixed-diameter cone and attached to the lower fixed-diameter cone, wherein the drill pipe passes through an opening in the upper fixed-diameter cone;

connecting a top of the lower tubular to a bottom of the upper launcher;

sealing the top of the lower tubular against the bottom of the upper launcher;

holding the first assembly and the second assembly using the drill pipe;

running-in-hole the first assembly and the second assembly;

pumping fluid into a bore of the drill pipe;

delivering the fluid below the lower fixed-diameter cone;

radially expanding the lower tubular using the lower fixed-diameter cone;

causing the drill pipe to slide through the opening while the lower tubular is expanded;

passing fluid located above the lower fixed-diameter cone through the opening while the lower tubular is expanded;

sealing the lower tubular against the lower section of the wellbore;

landing the stick-out into the opening in the upper fixed-diameter cone;

sealing the lower fixed-diameter cone against the upper fixed-diameter cone so as to prevent the fluid located above the lower fixed-diameter cone from continuing to pass through the opening after the stick-out has landed into the opening in the upper fixed-diameter cone;

radially expanding the upper tubular using the upper fixed-diameter cone;

sealing the upper tubular against the upper section of the wellbore;

retrieving the drill pipe, the lower fixed-diameter cone and the upper fixed-diameter cone from the wellbore.

18. The method of claim 17, wherein the lower launcher includes a shoe, the shoe being made of drillable material and having a port, the method comprising:

dropping an obturator inside the bore of the drill pipe; and closing the port with the obturator.

19. The method of claim 18, wherein a variable volume chamber is formed between the shoe and a seal located around the lower fixed-diameter cone after closing the port with the obturator, the method further comprising increasing pressure in the variable volume chamber using the fluid delivered below the lower fixed-diameter cone.

20. The method of claim 17, wherein the second assembly includes a mechanism located in the upper launcher and configured to support the upper fixed-diameter cone, the method comprising:

latching the lower fixed-diameter cone to the upper fixed-diameter cone after the stick-out has landed into the opening in the upper fixed-diameter cone.

21. The method of claim 20, further comprising:

providing an operational casing, wherein a top of the upper tubular is connected to the operational casing; and releasing a connection between the top of the upper tubular and the operational casing after the upper tubular is expanded.

* * * * *